US006942746B2

(12) United States Patent
Niejelow et al.

(10) Patent No.: US 6,942,746 B2
(45) Date of Patent: Sep. 13, 2005

(54) LENS BLOCKING SYSTEM

(75) Inventors: Nicholas G. Niejelow, Stratford, CT (US); Shane M. Swift, Bethany, CT (US)

(73) Assignee: Optima, Inc., Stratford, CT (US)

( * ) Notice: Subject to any disclaimer, the term of this patent is extended or adjusted under 35 U.S.C. 154(b) by 0 days.

(21) Appl. No.: 10/733,144

(22) Filed: Dec. 11, 2003

(65) Prior Publication Data

US 2005/0126687 A1 Jun. 16, 2005

(51) Int. Cl.[7] ..... B32B 31/18

(52) U.S. Cl. ..... 156/154; 156/153; 451/43; 451/44; 451/390; 451/460

(58) Field of Search ..... 156/153, 152, 156/154; 451/42, 43, 44, 390, 460

(56) References Cited

U.S. PATENT DOCUMENTS

| | | | | |
|---|---|---|---|---|
| 2,855,734 | A | 10/1958 | Gursch | |
| 3,962,833 | A | 6/1976 | Johnson | |
| 3,996,701 | A | 12/1976 | Ramirez | |
| 4,158,273 | A | 6/1979 | Olsen et al. | |
| 4,221,083 | A * | 9/1980 | Carroll | 451/42 |
| 4,227,349 | A | 10/1980 | Bicskei | |
| 4,267,208 | A | 5/1981 | Ireland | |
| 4,328,060 | A | 5/1982 | Tusinski et al. | |
| 4,356,989 | A | 11/1982 | Ireland | |
| 4,826,548 | A * | 5/1989 | Herbin et al. | 156/152 |
| 5,380,387 | A * | 1/1995 | Salamon et al. | 156/154 |
| 5,451,281 | A | 9/1995 | Lipman | |
| 6,149,750 | A * | 11/2000 | Parish, Jr. et al. | 156/154 |
| 6,258,200 | B1 * | 7/2001 | Kassab | 156/273.1 |
| 2002/0025765 | A1 | 2/2002 | Sangster et al. | |

* cited by examiner

*Primary Examiner*—Jeff H. Aftergut
(74) *Attorney, Agent, or Firm*—DeLio & Peterson, LLC; Peter W. Peterson

(57) ABSTRACT

A method of blocking ophthalmic lenses for edging comprises providing an ophthalmic lens having first and second surfaces, providing a first block for securing against the first lens surface and a second block for securing against the second lens surface. The method then includes placing an adhesive layer on the first block, placing a film having cling properties between the adhesive layer and the first lens surface, and urging the first block toward the first lens surface and the second block toward the second lens surface. The film having cling properties provides sufficient bonding force between the adhesive layer and the first lens surface to prevent the ophthalmic lens from slipping in the blocks during edging thereof.

24 Claims, 2 Drawing Sheets

LENS BLOCKING SYSTEM

BACKGROUND OF THE INVENTION

1. Field of the Invention

The present invention is directed to a process, system and apparatus for blocking ophthalmic lenses during edging and, in particular, to a system for blocking ophthalmic lenses that is particularly useful for lenses having slippery surface coatings.

2. Description of Related Art

In order to provide the proper shaped edge to an ophthalmic lens, so that the lens may properly fit into the frame of the eyeglasses, edging tools have long been used. These edging tools capture the ophthalmic lens between blocks applied to the lens surface and, using a frame guide having the configuration of the eyeglass frame, rotate the lens edge against a grinding wheel to impart the desired shape. One such edging tool is the Edgemaster sold by Oxford Corporation. In order to hold the block firmly to the surface of the ophthalmic lens, while at the same time permitting easy removal of the lens from the block without damage thereto, adhesive pads have been employed between the block and the lens surface. One such system is the LEAP System sold by the 3M Company comprising a high-density butyl rubber material having adhesives on both sides. More recent improvements to blocking tapes have been recorded in U.S. Pat. No. 6,149,750, wherein there is provided a tape having a polymeric backing and a pressure sensitive adhesive. The polymeric backing side is attached to the block and the adhesive side is attached to the lens surface.

A method of protecting the surface of the lenses during the edging process is disclosed in U.S. Pat. No. 5,451,281. This process utilizes a film having cling properties that is applied over the surface of the lens to protect it from scratching, except for the central portion of the lens. An opening is provided in the cling film to permit the blocking adhesive pad to adhere to the lens surface. Similar vinyl cling-type films have been used to protect lens surfaces during other processing, for example, during the drilling of holes in the lens for attachment to an eyeglass frame.

The development of certain types of coatings has resulted in difficulty in properly blocking lenses with the system described above. In particular, certain coatings such as super-hydrophobic anti-reflective (AR) coatings are very slippery and do not adhere well to pressure sensitive adhesives, so that the types of adhesives employed in the adhesive blocking pads described above are ineffectual in firmly holding the lens during edge grinding. As a result, there has been substantial slippage and general inability to properly secure the lens during edge grinding.

SUMMARY OF THE INVENTION

Bearing in mind the problems and deficiencies of the prior art, it is therefore an object of the present invention to provide an improved method of blocking ophthalmic lenses for an edging process.

It is another object of the present invention to provide an improved process system and apparatus for blocking lenses having slippery coatings thereon.

A further object of the invention is to provide a method, system and apparatus for securing ophthalmic lenses during edge grinding, which provides a high degree of bonding yet is easily removed and does not damage the lens surface.

The above and other objects, which will be apparent to those skilled in art, are achieved in the present invention which is directed to a method of blocking ophthalmic lenses for edging comprising providing an ophthalmic lens having first and second surfaces, providing a first block for securing against the first lens surface and a second block for securing against the second lens surface. The method then includes placing an adhesive layer on the first block, placing a film having cling properties between the adhesive layer and the first lens surface, and urging the first block toward the first lens surface and the second block toward the second lens surface. The film having cling properties provides sufficient bonding force between the adhesive layer and the first lens surface to prevent the ophthalmic lens from slipping in the blocks during edging thereof.

The method further includes grinding the edge of the ophthalmic lens while it is held between the first block, the adhesive layer and the film having cling properties on the first lens surface, and the second block on the second lens surface.

In another aspect, the present invention provides an apparatus for blocking ophthalmic lenses having first and second surfaces for edging. The apparatus comprises a first block for securing against the first lens surface, and a second block for securing against the second lens surface. An adhesive layer is disposed on the first block, and a film having cling properties is disposed between the adhesive layer and the first lens surface. The film having cling properties provides sufficient bonding force between the adhesive layer and the first lens surface to prevent the ophthalmic lens from slipping in the blocks during edging thereof.

The first block has a surface with a configuration to apply pressure substantially uniformly to the first lens surface, and the adhesive layer is adhered to the first block surface. The adhesive layer is preferably a double-sided adhesive layer.

The method of the present invention is particularly useful where the ophthalmic lens has a hydrophobic anti-reflective coating on the first surface, although it may be used with other types of lenses, with or without coatings.

The film having cling properties may be a vinyl compound, polyethylene, polypropylene, or copolymers thereof.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
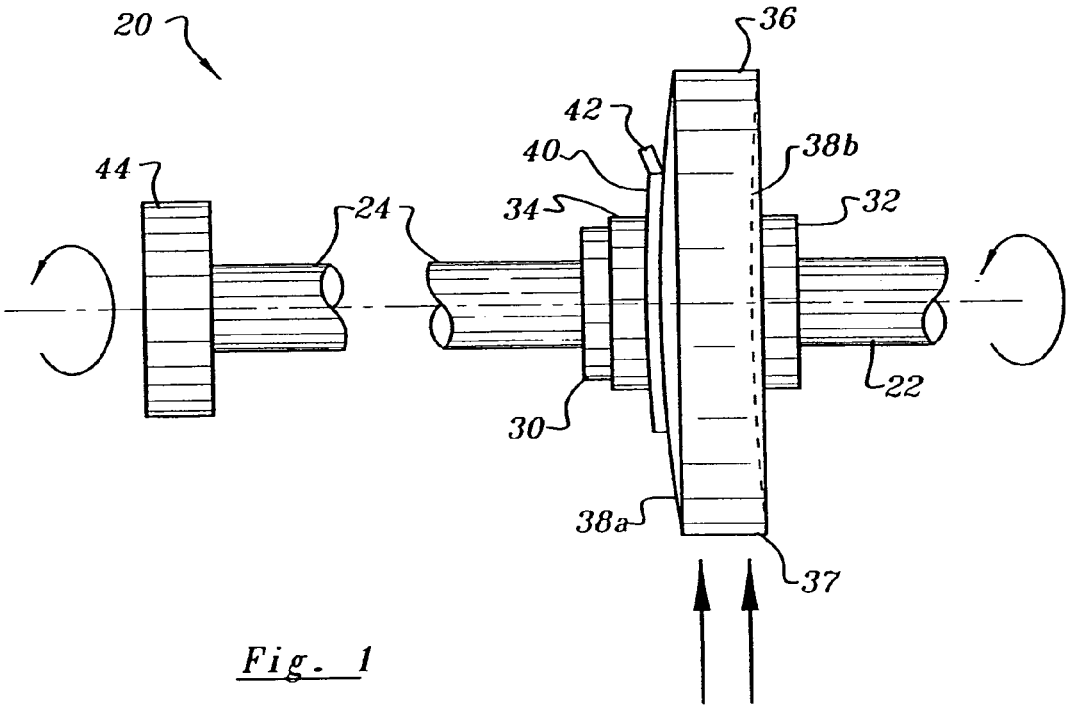
FIG. 1 is a side elevational view of the preferred edge grinding system incorporating the blocking of the present invention.
Figure 2:
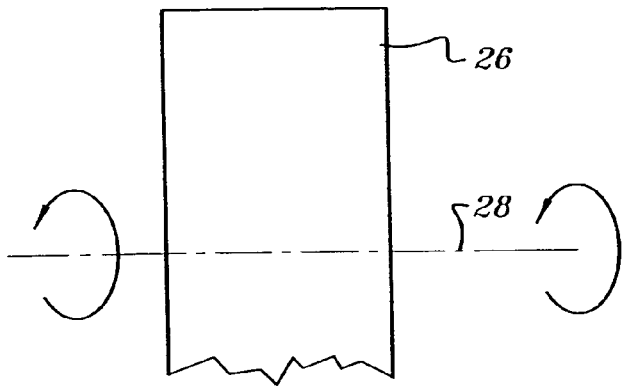
FIG. 2 is a perspective view of a block used in FIG. 1.
Figure 2:
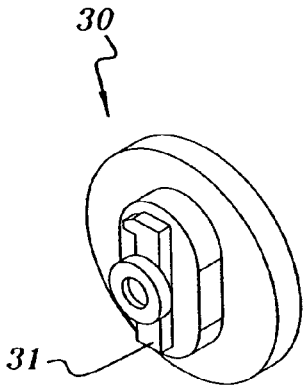
Figure 3:
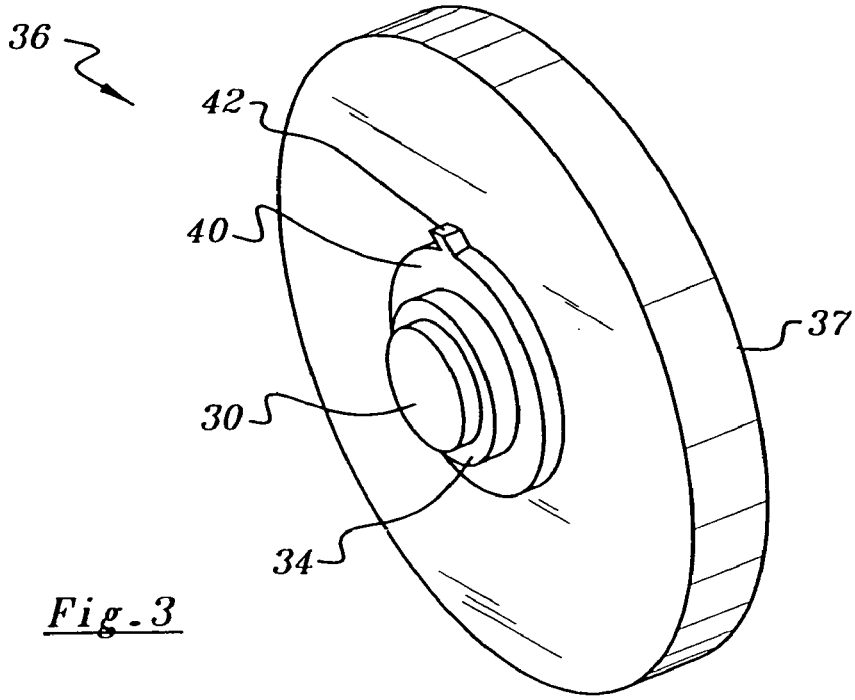
FIG. 3 is a perspective view of an ophthalmic lens having applied thereto the film with cling properties of the present invention, an adhesive pad and a block.
Figure 4:
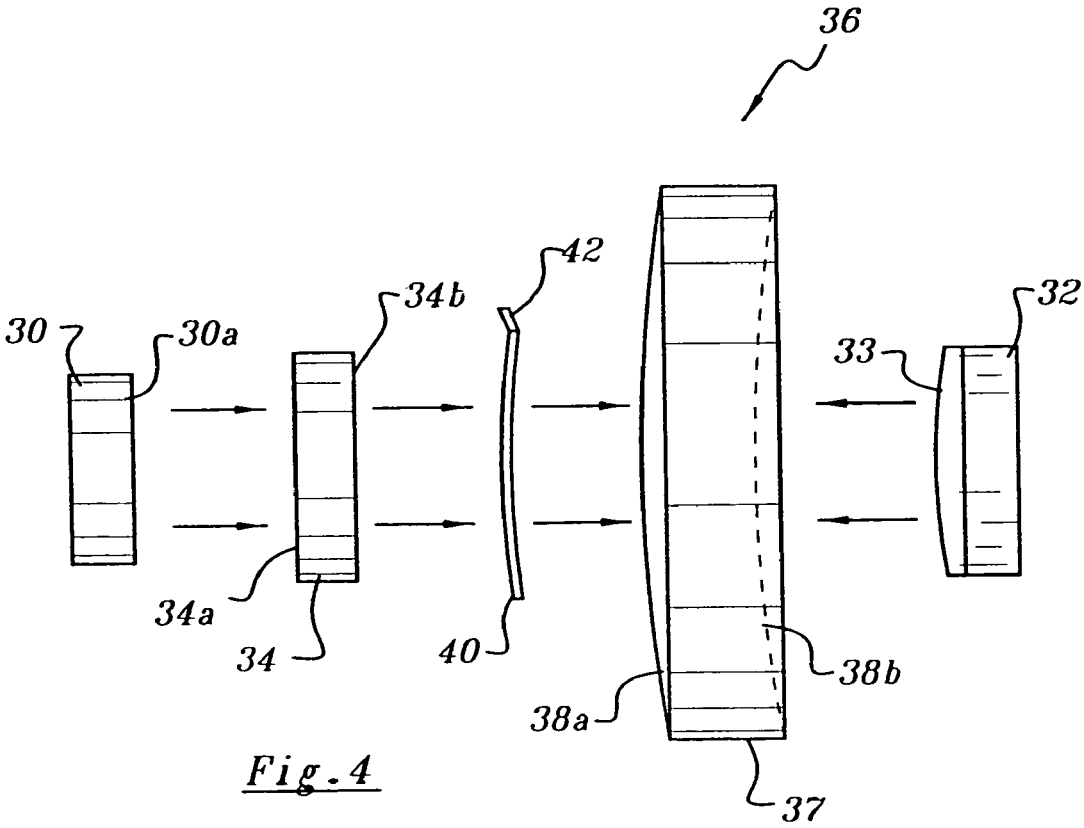
FIG. 4 is a side exploded view of the ophthalmic lens in FIG. 1 showing position of the blocking pads, adhesive layer and cling film of the present invention.

In describing the preferred embodiment of the present invention, reference will be made herein to FIGS. 1–4 of the drawings in which like numerals refer to like features of the invention.

The preferred edging system 20 utilizes a grinding wheel 26, which is rotated about axis 28 by a motor (not shown), to grind the edge of ophthalmic lens 36. Grinding wheel 26 is typically made of brass having a surface embedded with diamond grinding media. The ophthalmic lens 36 whose edge 37 is to be ground to conform to the opening or shape of the eyeglass frames has a front convex surface 38*a* and a rear, concave surface 38*b*. A block 32 having a felt surface 33 (FIG. 4) is mounted on shaft 22, and contacts the rear surface 38*b* of the lens near its optical center. On the opposite side of the lens, a block 30 releasably attached to shaft 24 has adhered to the surface facing the lens an adhesive pad 34. As shown in more detail in FIG. 2, block 30 has a key portion 31 which may fit into the end of shaft 24 to prevent rotation of the block with respect to the shaft. Adhesive pad 34 has thereon adhesive layers on both surfaces 34*a*, 34*b*. Such adhesive is normally a pressure sensitive adhesive that is easily removed from a lens surface. At the opposite end of shaft 24 there is mounted frame guide 44, which has the configuration of the eyeglass frame. Frame guide 44 is rotated against a fixed member and, as it does so, shafts 24 and 22 are moved toward and away from the grinding wheel 26 so that edge 37 of the ophthalmic lens is shaped to conform to the eyeglass frame.

The equipment described to this point is typical in edge grinding, and normally the adhesive on side 34*b* of adhesive block 34 is applied directly to the front surface 38*a* of lens 36. However, contrary to the prior art, the present invention provides an intermediate film or membrane layer 40 between the adhesive layer on adhesive block 34, and the front surface 38*a* of lens 36. This film is treated to have cling properties so that it adheres to the surface of lens 36, whether that surface is coated or not. Such cling is typically referred to as static cling. The cling film is free of pressure-sensitive or other adhesive, except for any treatment that may be present to provide static cling properties.

The cling-type film useful in the present invention preferably is a soft, pliable membrane which can conform to the contour of the ophthalmic lens. Plastic film materials include vinyl compounds such as polyvinyl chloride, polyvinyl alcohol, ethylene vinyl acetate, acrylics, polyethylene, polypropylene, and copolymers and blends of the above. Such films may be multi-layer materials, with the overall cling properties of films being determined by one or more layers of polymer and/or additives. Preferred among these is a vinyl film. The sheet of cling-type film should be larger in size than the adhesive layer 34, and smaller than the surface area of the lens to which it is applied. Cling film 40 preferably has a thickness of about 0.005 to 0.012 in., more preferably about 0.008 in.

Lens 36 may be made of any optically transparent material normally used for ophthalmic applications, and is typically a plastic such as a polycarbonate. The ophthalmic lenses with which the present invention is most useful are those having super hydrophobic AR coatings such as the Optool-DSX lens coating supplied by Daikin America. The blocking system of the present invention is also useful with bifocal lenses, high index and other lenses that have high base curves. Block 30 has a bearing surface 30*a* that conforms generally to the surface of the lens to be supported. Since many ophthalmic lenses have a very high radius of curvature, and because the intermediate adhesive layer 34 and cling film layer 40 are typically soft and flexible, surface 30*a* of the block can be essentially flat. Minor grooves in the surface do not detract from its ability to apply essentially a uniform force across its entire surface against the lens.

In setting up the lens for edging, initially the adhesive layer 34 is generally applied to the face 30*a* of block 30, and block 30 applied to a chuck on shaft 24. The cling-film 40 is normally applied to the center of the concave surface 38*a* of lens 36, so that the adhesive layer may be subsequently applied to the cling-type film already in position on the lens. Blocks 30 and 32 are then urged toward each other to capture the lens therebetween, with block 32 and felt facing material 33 urged against the concave surface 38*b*, and block 30, adhesive layer 34 and cling film 40 urged against the convex surface 38*a*. The grinding wheel is then turned on and suitable liquid coolant is applied to cool the lens edge 37 as it is ground by wheel 26.

While the preferred invention applies the cling-type film to convex side 38*a* of the lens, the blocking may be set up with the lens in the reverse configuration, with the film 40 applied to the concave side 38*b*. Also, film 40 and adhesive layer 34 may be applied to both sides of the lens, if desired.

After concluding the edging operation, the blocks are then separated and cling film 40 is peeled off surface 38*a* by means of a pull tab 42 which has no cling properties, leaving the surface 38*a* free of any adhesive or other marks.

Contrary to accepted thought, the present invention provides better blocking properties by eliminating the application of the adhesive layer to the surface of the ophthalmic lens. It is particularly useful for blocking lenses having slippery coatings thereon, and provides a high degree of bonding, yet is easily removed and does not damage the lens surface.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of blocking ophthalmic lenses for edging comprising providing an ophthalmic lens having first and second surfaces, providing a first block for securing against the first lens surface and a second block for securing against the second lens surface, placing an adhesive layer on the first block, placing a film having cling properties between the adhesive layer and the first lens surface, and urging the first block toward the first lens surface and the second block toward the second lens surface, whereby the film having cling properties provides sufficient bonding force between the adhesive layer and the first lens surface to prevent the ophthalmic lens from slipping in the blocks during edging thereof.

2. The method of claim 1 wherein the ophthalmic lens has a hydrophobic anti-reflective coating on the first surface.

3. The method of claim 1 wherein the adhesive layer is a double-sided adhesive layer.

4. The method of claim 1 wherein the film having cling properties is selected from the group consisting of vinyl compounds, polyethylene and polypropylene.

5. The method of claim 1 wherein the film having cling properties is a vinyl compound.

6. The method of claim 1 wherein the first block has a surface with a configuration to apply pressure substantially uniformly to the first lens surface, and the adhesive layer is adhered to the first block surface.

7. The method of claim 1 further including grinding the edge of the ophthalmic lens while it is held between the first block, the adhesive layer and the film having cling properties on the first lens surface, and the second block on the second lens surface.

8. The method of claim 7 further including, after grinding, removing from the lens the first block, the adhesive layer and the film having cling properties on the first lens surface to leave the first lens surface free of any marks.

9. A method of blocking and edging ophthalmic lenses having hydrophobic anti-reflective coatings comprising:

providing an ophthalmic lens having first and second surfaces, the lens having a hydrophobic anti-reflective coating on at least the first surface;

providing a first block having a surface with a configuration to apply pressure substantially uniformly to the first lens surface and a second block for applying pressure against the second lens surface;

placing an adhesive layer on the first block surface;

placing a film having cling properties between the adhesive layer and the first lens surface;

urging the first block toward the first lens surface and the second block toward the second lens surface to hold the ophthalmic lens therebetween; and grinding the edge of the ophthalmic lens, whereby the film having cling properties provides sufficient bonding force between the adhesive layer and the first lens surface to prevent the ophthalmic lens from slipping in the blocks during edging thereof.

10. The method of claim 9 wherein the adhesive layer is a double-sided adhesive layer.

11. The method of claim 9 wherein the film having cling properties is selected from the group consisting of vinyl compounds, polyethylene and polypropylene.

12. The method of claim 9 wherein the film having cling properties is a vinyl compound.

13. The method of claim 9 further including, after grinding, removing from the lens the first block, the adhesive layer and the film having cling properties on the first lens surface to leave the first lens surface free of any marks.

14. In a blocking system for edging ophthalmic lenses having first and second surfaces, a first block for securing to the first lens surface and a second block for securing to the second lens surface, and an adhesive layer between the first block and the first lens surface, the improvement comprising providing a film having cling properties between the adhesive layer and the first lens surface.

15. The system of claim 14 wherein the film having cling properties is selected from the group consisting of vinyl compounds, polyethylene and polypropylene.

16. The system of claim 14 wherein the film having cling properties is a vinyl compound.

17. The system of claim 14 wherein the film having cling properties is removable from the first lens surface to leave the first lens surface free of any marks.

18. An apparatus for blocking ophthalmic lenses having first and second surfaces for edging comprising: a first block for securing against the first lens surface; a second block for securing against the second lens surface; an adhesive layer disposed on the first block; a film having cling properties disposed between the adhesive layer and the first lens surface, the film having cling properties providing sufficient bonding force between the adhesive layer and the first lens surface to prevent the ophthalmic lens from slipping in the blocks during edging thereof.

19. The apparatus of claim 18 wherein the ophthalmic lens has a hydrophobic anti-reflective coating on the first surface.

20. The apparatus of claim 18 wherein the adhesive layer is a double-sided adhesive layer.

21. The apparatus of claim 18 wherein the film having cling properties is selected from the group consisting of vinyl compounds, polyethylene and polypropylene.

22. The apparatus of claim 18 wherein the film having cling properties is a vinyl compound.

23. The apparatus of claim 18 wherein the first block has a surface with a configuration to apply pressure substantially uniformly to the first lens surface, and the adhesive layer is adhered to the first block surface.

24. The apparatus of claim 18 wherein the film having cling properties is removable from the first lens surface to leave the first lens surface free of any marks.

* * * * *